United States Patent [19]

De Luca et al.

[11] Patent Number: 5,065,895

[45] Date of Patent: Nov. 19, 1991

[54] VARIABLE SUPPORT FOR FAN-FOLDED PAPER DISPENSER

[75] Inventors: Raymond F. De Luca, Samford, Conn.; Paul W. Jespersen, Houston, Tex.

[73] Assignee: Georgia Pacific Corporation, Atlanta, Ga.

[21] Appl. No.: 388,396

[22] Filed: Aug. 2, 1989

[51] Int. Cl.[5] ..... A47K 10/24

[52] U.S. Cl. ..... 221/54; 221/251

[58] Field of Search ..... 221/53, 54, 251, 221, 221/46, 197, 311, 312 R, 312 B

[56] References Cited

U.S. PATENT DOCUMENTS

| | | | |
|---|---|---|---|
| 744,047 | 11/1903 | Casterline et al. | 221/53 |
| 744,047 | 11/1903 | Casterline | 221/53 |
| 1,509,048 | 9/1924 | Marcase | 221/54 |
| 1,605,231 | 11/1926 | Hoberg | 221/53 |
| 1,681,840 | 8/1928 | Carlson | 221/334 |
| 1,783,149 | 11/1930 | Jantzen | 221/54 |
| 2,195,437 | 4/1940 | West | 221/48 |
| 2,703,664 | 3/1955 | Rabkin et al. | 221/251 |
| 3,135,424 | 6/1964 | Peppler | 221/251 |
| 4,013,179 | 3/1977 | Flack | 221/251 |

*Primary Examiner*—D. Glenn Dayoan
*Assistant Examiner*—Kenneth Noland
*Attorney, Agent, or Firm*—Banner, Birch, McKie & Beckett

[57] ABSTRACT

A dispesner for a stack of fan-folded sheet material is disclosed. The dispenser housing has a pivoting brake at the rear wall and contains a major support roller at a height above the rear support rollers to minimize the weight of the stack on the rear support rollers. The major support roller is movably mounted in a pair of vertically-disposed slots and connected at either end to one of a pair of pivot arms. The pivot arms are connected across the width of the dispenser by a connector. The weight of the stack causes the major suport roller to move downwardly in the vertically disposed slots which causes the pivot arms to rotate in the clockwise direction. The clockwise rotation of the pivot arms brings the connector into contact with the pivoting brake which presses against the stack of sheet material in the lateral direction. The lateral pressure on the sheet material decreases the vertical pressure on the bottommost piece of sheet material making it easier for such piece to be removed intact from the dispenser. A piece of friction material may be placed along the inner surface of the front of the dispenser to provide additonal friction on the stack to further decrease the vertical pressure on the bottommost piece of sheet material. An alternative embodiment uses a flat spring in lieu of the pivoting brake, pivot arms and connector. Another alternative embodiment uses two pivoting rollers and a rear brake which forms part of the back wall and is pivotally connected to each side of the dispenser.

12 Claims, 5 Drawing Sheets

VARIABLE SUPPORT FOR FAN-FOLDED PAPER DISPENSER

BACKGROUND OF THE INVENTION

The present invention relates to an apparatus for dispensing pieces of paper or like web material from the bottom of a dispenser while minimizing the pressure and accompanying friction experienced by the piece of web material.

In conventional dispensers for Z-folded or fan-folded paper towelling, the towel web is drawn from the bottom of the dispenser. As the web is withdrawn, the weight of the stack against the bottom support rollers in the dispenser creates friction which makes it difficult to withdraw relatively weak-strength paper towelling without breaking or tearing, especially if the user has wet hands contacting and further weakening the paper towelling. With short stacks of towelling in the dispenser, such friction is generally low and usually is not sufficient to cause breakage or tearing. However, when multiple packages of towelling are loaded into the dispenser, the friction is sufficiently high, and it does lead to breaking or tearing of the towel when it is withdrawn from the dispenser.

Various devices for dispensing fan-folded sheet material have been proposed. West in U.S. Pat. No. 2,195,437 teaches an invention in which a portion of the interior walls is roughened or corrugated to impart friction to the stack of tissues. The increased friction lessens the tendency for multiple tissues to be pulled from the dispenser at the same time.

Carlson in U.S. Pat. No. 1,681,840 teaches an invention in which the stack of web material is supported at one edge by a narrow supporting shelf and at the other edge by a spring-loaded finger. Supporting the towel stack along its edges permits the lower side of the stack to be bowed downwardly such that slight tension is exerted on the lower towels to facilitate the removal of the towels from the dispenser.

Hoberg in U.S. Pat. No. 1,605,231 teaches an invention in which reversely curved supporting members including crowned portions are provided. The crowned portions tend to comprise the principal support for the interfolded sheets, thereby decreasing the pressure and accompanying friction on the interfolded sheets adjacent the folded margins. Flanges are also provided to support the edges of the towel stack. The flanges take part of the weight of the stack at its interfolded edges off the bottom of the dispenser. Removing the weight from the interfolded ends allows the end of the next sheet to be removed from the dispenser with greater ease.

Casterline et al. in U.S. Pat. No. 744,047 teach an invention in which a pair of retarding devices are provided to bear against the sides of the stack of material. The retarding devices provide a lateral force against the stack and support much of the weight of the stack above the retarding devices, thereby decreasing the pressure on the bottommost piece of web material. The retarding devices permit uniform pressure at the discharge opening regardless of the weight or size of the stack.

In dispensers for fan-folded web material, it is important to minimize the pressure and friction experienced by the bottommost piece of web material. In the ideal dispenser such pressure and friction can be minimized by the application of a lateral force. The lateral force and accompanying lateral pressure should be sensitive to the amount of web material present in the dispenser, i.e., the mechanism providing the lateral force should be self-adjusting to increase the lateral pressure when an increased amount of web material is provided. The prior art does not disclose such a dispenser.

SUMMARY OF THE INVENTION

The web material dispenser of this invention is designed to minimize the possibility of tearing or breaking the piece of material being pulled from the dispenser.

The dispenser housing has a pivoting brake at the rear wall and contains a major support roller which supports more of the weight of the stack material than the rear support rollers. The major support roller is movably mounted in a pair of vertically-disposed slots and connected at either end to one of a pair of pivot arms. The pivot arms are connected across the width of the dispenser by a connector. The weight of the stack causes the major support roller to move downwardly in the vertically-disposed slots causing the pivot arms to rotate clockwise, thus bringing the connector into contact with the pivoting brake. As the pivoting brake moves forward, it provides a lateral pressure against the stack of web material which decreases the vertical pressure on the bottommost piece of sheet material.

With the foregoing in mind, it is an object of the present invention to provide a fan-folded material dispenser which holds more than one stack/package of fan-folded sheet material to minimize the maintenance time of the custodial staff expended while checking or replacing the sheet material.

It is also an object of the invention to provide a self-adjusting mechanism which automatically senses the weight of the stack of material and proportionately varies the lateral force applied to that stack to decrease the possibility of tearing or breaking of the sheet of web material as it is pulled from the dispenser.

It is a further object of the invention to provide rollers to further decrease the friction on the bottommost sheet of web material to further decrease the possibility of tearing or breaking the sheet of web material as it is pulled from the dispenser.

It is a further object of the invention to provide friction material along the inside surface of the dispenser to further increase the friction on the stack which is induced by the lateral pressure, thereby further reducing the friction on and the possibility of tearing the bottommost sheet of web material in the dispenser.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there are illustrated and described preferred embodiments of the invention.

DETAILED DESCRIPTION OF THE PREFERRED EMBODIMENT

Figure 2:
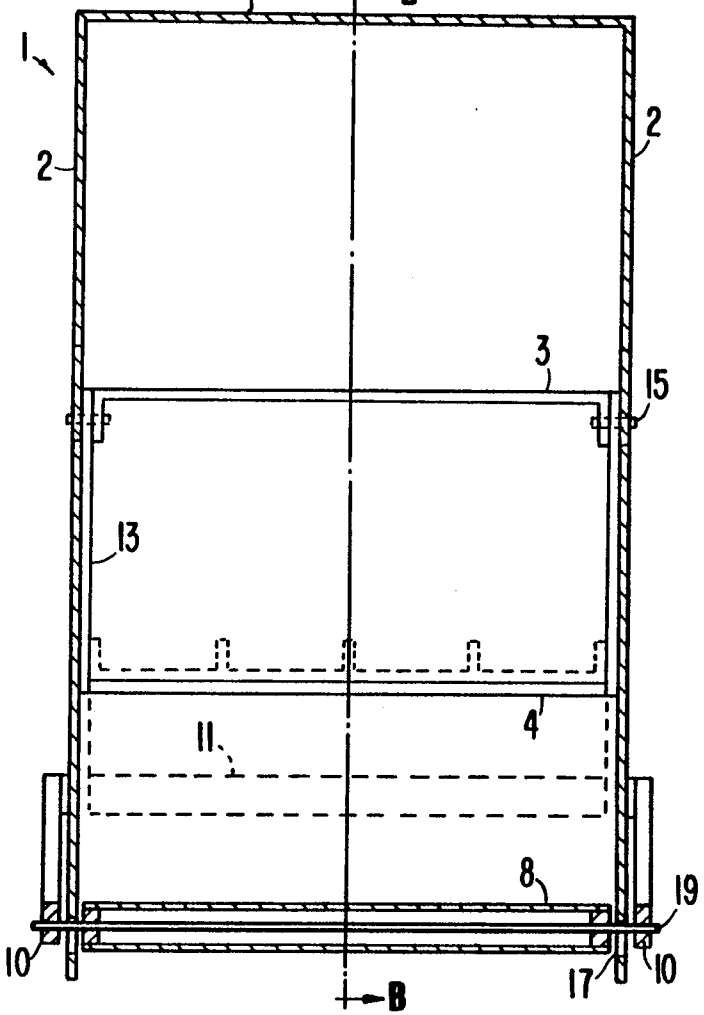
FIG. 2 is a front view of the preferred embodiment in sectional view taken along line A—A of FIG. 1.
Figure 1:
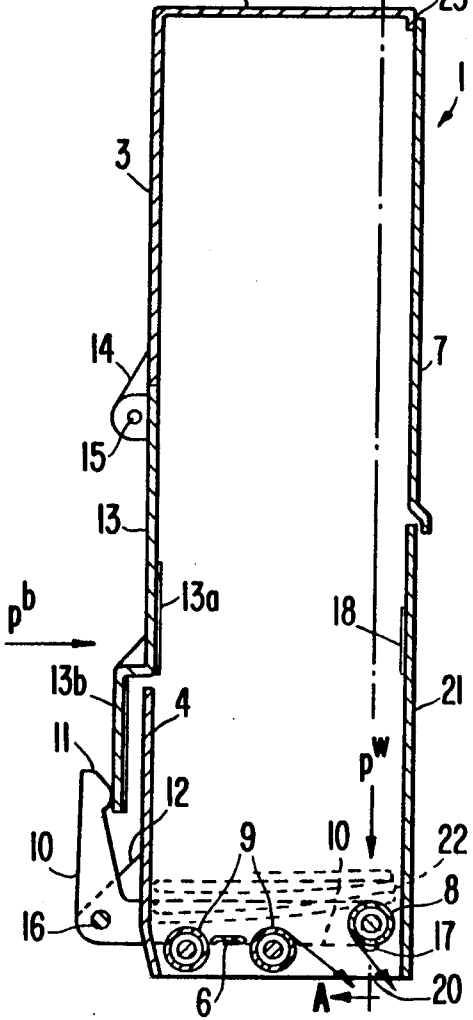
FIG. 1 is a side view of the preferred embodiment in a sectional view taken along line B—B of FIG. 2.

FIGS. 1 and 2 illustrate the paper dispenser or dispenser housing 1 of the present invention. The dispenser housing comprises a top 5, side plates 2, an upper back plate 3, which is fixedly connected to the top 5 and side plates 2, a hinged front cover 7, which is hingedly connected to the housing at hinge connection 23, a lower backplate 4, a bottom plate 6, and front plate 21. Each side plate 2 has an upper portion and a lower portion. Depending from each side plate at the upper portion is an upper side plate extension 14 and at the lower portion of each side plate is a lower side plate extension 12. A pivoting brake 13 depends from and is hingedly connected to each upper side plate extension 14 by pivot pins 15. The pivoting brake 13 comprises an upper braking portion 13*a* and a lower lever portion 13*b*. Bottom plate 6 is connected at each side to one of the side plates 2. Low-friction support means, which may be smooth non-rotating tubes or rollers is provided to further lower the friction on the bottommost sheet of web material. The preferred low-friction support means comprises two rear support rollers. Each of the two rear support rollers 9 is rotatably connected at either end to a side plate 2. The rear support rollers 9 are located adjacent to the bottom plate 6 in the lower rear portion of the dispenser housing 1. A major support roller 8 is located across the lower front of dispenser housing 1 at a higher elevation than either of the rear support rollers 9. The major support roller 8 turns about its shaft 19, which projects through the vertically-directed slots 17 in each side plate 2, to connect with pivot arms 10. Each pivot arm 10 is rotatably connected to a lower side plate extension 12 by pins 16. The two pivot arms are connected to each other by a connector 11 across the width of the dispenser housing 1. A strip of friction material 18, if needed, may be affixed to the inside surface of front plate 21 substantially opposite from the inside surface of the pivoting brake 13.

In operation, the hinged front cover 7 is pivoted upwardly and outwardly to expose the interior of dispenser housing 1. At least one package or stack of web-material is placed in the dispenser housing. It is known to one of ordinary skill in the dispenser art that web material such as paper towels can be configured as a plurality in a Z-fold or in a fan-fold. A Z-fold or fan-fold is visualized by folding each sheet of web material to have a single transverse fold 22 defining a pair of flaps. One flap is placed between the flaps of the immediately superadjacent sheet of web material and the other flap is placed between flaps of the immediately subadjacent sheet of web material. A plurality of sheets of web material configured in a Z-fold or fan-fold is sold in a package or stack.

With the stack of web material in the housing, the major support roller will support most of the weight $p^w$ of the web material due to the major support roller's location higher than the rear support rollers. With the web material resting on rollers 8 and 9, the web end at the bottom of the fan-fold is threaded between rollers 8 and 9 to exit the housing at 20. As the weight of the stack presses against the major support roller 8, the roller will move down in slot 17, causing pivot arms 10 to rotate clockwise, which causes the pivoting brake 13 to move forward. The forward movement of the pivoting brake 13 presses the stack of web material towards the front plate 21 and friction material 18. If an additional package of web material is loaded into the housing and the hinged front cover 7 is closed, the additional weight will move the major support roller 8 further down, resulting in additional pressure against the inner walls of the friction strip 18 and the upper braking portion 13*a*. The friction created by the pressure of the brake 13 helps support the weight of the packages of web material, thus insuring that the pressure of the material on rollers 8 and 9 is kept at a minimum.

As dimensioned in FIG. 1, the brake pressure $p^b$ is about three times the pressure $p^w$ on the major support roller 8. The coefficient of friction for paper toweling on a smooth surface is about 0.3. It is thus apparent that by (a) choosing the proper leverage between the major support roller 8 and the pivoting brake 13, as well as the friction surface 18, the dispenser can be designed to support the weight of the web material and keep the pressure on the support rollers at a desired minimum. As the leading end of the web material is pulled from the dispenser at 20, the major support roller 8 will rotate counter clockwise, releasing the lower fold 22 from the stack of material at the front. The next lowest fold will not follow with, as it is restrained by its contact at the back with backplate 4 which is bent forward slightly for this purpose. Continual pulling will then rotate rear supporter rollers 9 clockwise, releasing the fold directly above. Due to the looseness of the folds in the web directly above the rear support rollers, very little pulling effort is needed at this point. To pull the folds out from above the support rollers, only about a half-inch of material need be pulled at each end. When enough of the web material in the dispenser has been used so that the top of the stack is below the bottom of pivoting brake 13, the stack will be light enough in weight to no longer need the brake pressure to help support the weight of the stack.

It can be seen that as the weight of the stack decreases, the braking pressure automatically decreases also. It is further noted that the force from pulling the folded web out from the major support roller will move said roller down slightly, thus helping to release the folded web material.

Figure 3:
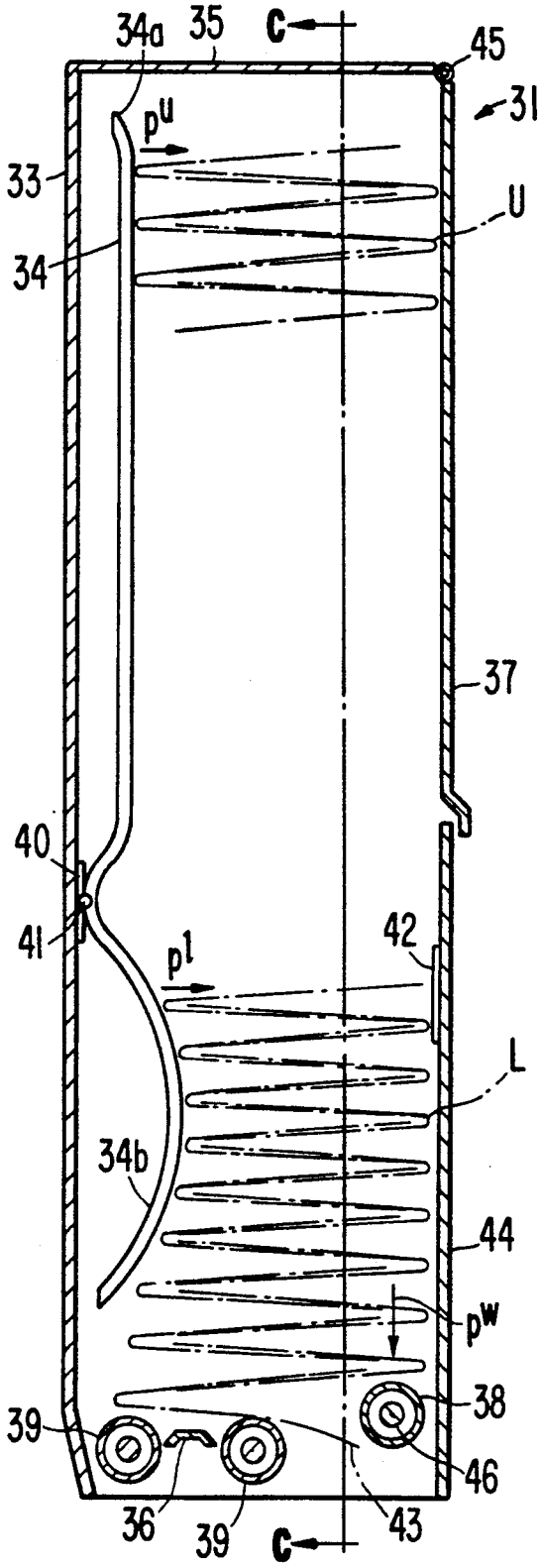
FIG. 3 is a side view of an alternate embodiment in sectional view taken along line D—D in FIG. 4.
Figure 5:
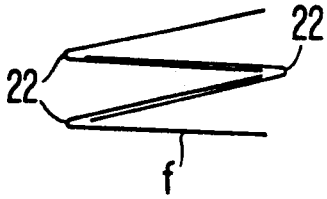
FIG. 5 is a side elevational view of the fan-folded web material.
Figure 4:
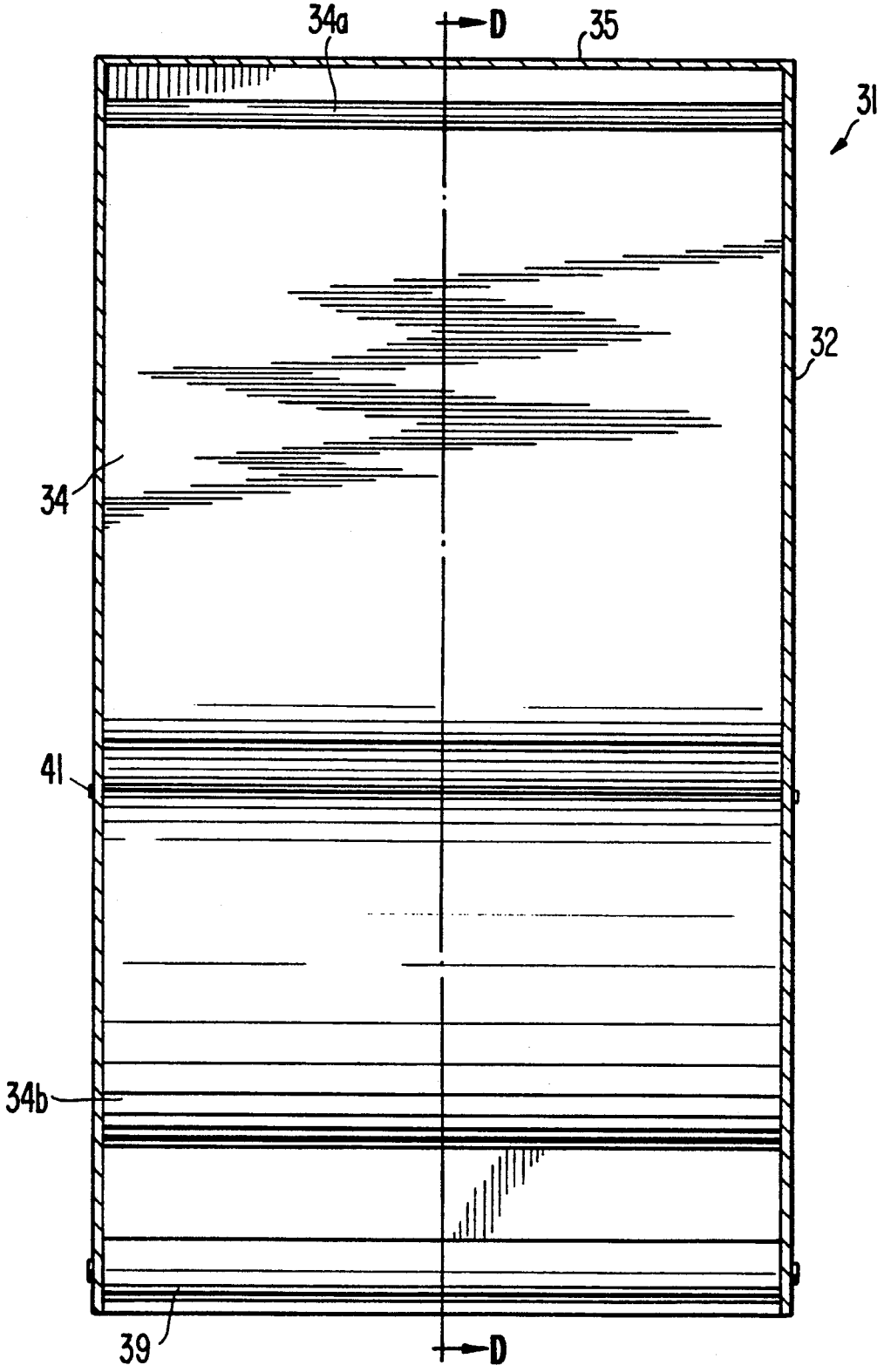
FIG. 4 is a front view of the alternate embodiment of FIG. 3 in sectional view taken along line C—C of FIG. 3.

Referring to FIG. 3 an alternative embodiment of the paper dispenser is illustrated. The paper dispenser or dispenser housing 31 comprises a top 35, side plates 32, a back plate 33, which is fixedly connected to the top 35 and the side plates 32, a hinged front cover 37, which is rotatably connected to the top 35 at hinge connection 45, a bottom plate 36 and a front plate 44. A backplate extension 40 extends inwardly from the inside surface of the back plate 33. A flat spring 34 comprising upper arm 34*a* and lower arm 34*b* is pivotally connected to back plate extension 40 by pivot pin 41.

The pivot pin 41 is connected to the flat spring proximal to the juncture of the upper and lower arms. This juncture may be anywhere along the length of the flat spring but, preferably, the upper arm should be substantially longer than the lower arm to prevent excessive pressure from buckling the relatively loose sheets near the top of the stack. The rear support rollers 39 and the bottom plate 36 are positioned within and connected to the dispenser housing 31 in the same fashion as in the preferred embodiment. The major support roller 38 is located across the lower front of the dispenser housing at a higher elevation than either of the rear support rollers 39. The major support roller 38 turns about its shaft 46 and is connected to side plates 32 in the same fashion as the rear support rollers 39. A strip of friction material 42, if needed, may be affixed to the inside surface of front plate 44 substantially opposite from lower surface 34*b*. At least one package or stack of web material is placed in the dispenser housing. With the stack of web material in the housing, the major support roller 38 will support most of the weight $p^w$ of the web material due to said major support roller's location higher than the rear support rollers. The spring's upper arm 34*a* presses against the upper portion of the stack U creating lateral force and pressure $p^u$. The spring's lower arm 34*b* presses against the lower portion of the stack L creating lateral force and pressure $p^l$. The friction created by the pressure of the upper and lower arms of the spring helps support the weight of the stack of web material, thus insuring that the pressure of the web material on rollers 8 and 9 is kept at a minimum. The operation of the rollers and removal of the web material proceeds in a substantially similar fashion as in the preferred embodiment.

Figure 6:
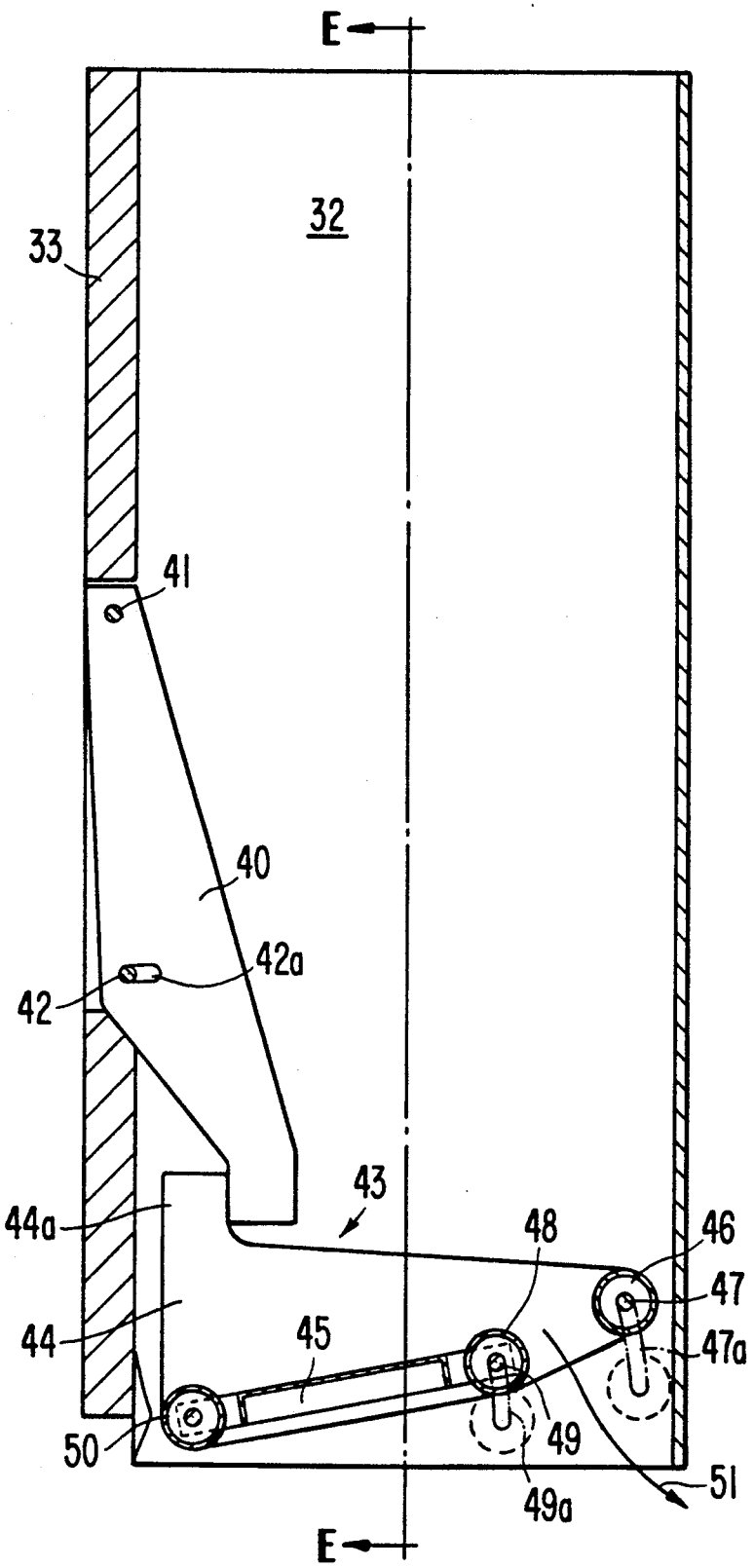
FIG. 6 is a side view of a different alternate embodiment in sectional view.
Figure 7:
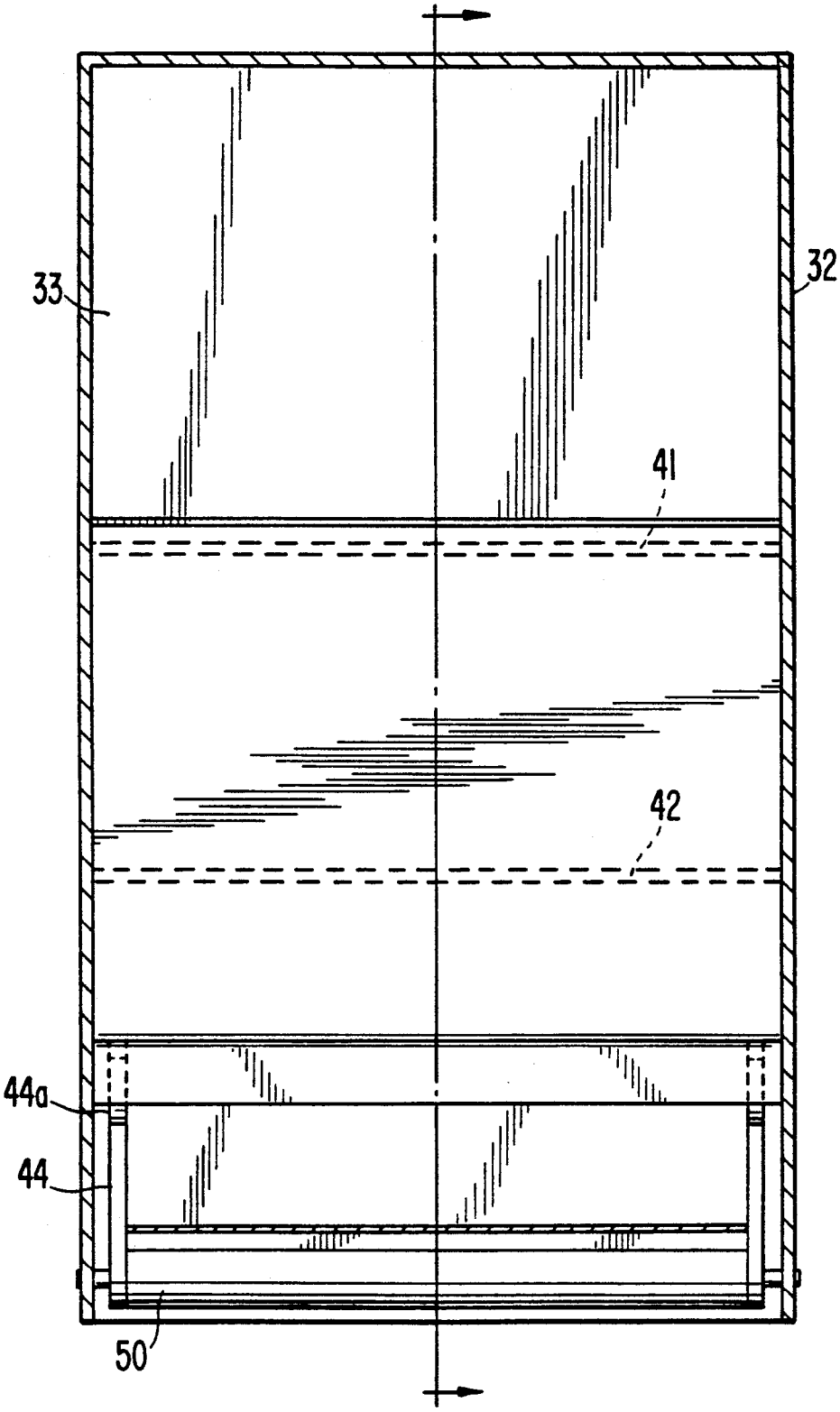
FIG. 7 is a front view of the alternate embodiment of FIG. 6 in sectional view taken along line E—E of FIG. 6.

Referring to FIGS. 6 and 7 another embodiment of the paper dispenser is disclosed.

The paper dispenser or dispenser housing comprises a top, side plates 32, a back plate 33, which is connected to the top and the side plates, a hinged front cover, and a front plate. A pivoting brake 40 is pivotally connected to the housing by an upper pivot pin 41, which is connected to both side plates 32. Alternatively, two pivot pins, one connected to each side plate may be used. A lower pivot pin 42 disposed in arcuate slot 42*a* limits the rotational movement of the pivoting brake 40. The lower pivot pin 42 may be connected to both side plates 32 or two lower pivot pins may be used with each pin connected to a side plate.

Lower pivoting portion 43 comprises two thin L-shaped portions 44 having a plurality of through holes and contact part 44*a* which connects the two L-shaped portions at an upper point. Bottom plate 45 connects the L-shaped portions at a lower point. Bottom plate 45 also supports the stack of web material. Major support roller 46 has a shaft 47 and is connected to the lower pivoting portion and side plates by its shaft. Arcuate slots 47*a* in each side plate allow the major support roller and the lower pivoting portion to pivot upwardly in a counter clockwise direction as the weight of the stack of web material decreases. Middle support roller 48 has a shaft 49 which connects the middle support roller to the lower pivoting portion and the side plates. Arcuate slots 49*a* in each side plate allow the middle support roller and the lower pivoting portion to pivot upwardly in a counter clockwise direction as the weight of the stack of web material decreases. Rear support roller 50 has a shaft and is pivotally connected by its shaft to lower pivoting portion 43 and side plates 32. A sheet of web material exist the housing at 51.

While the invention has been described in connection with what is presently considered to be the most practical and preferred embodiment, it is understood that the invention is not to be limited to the disclosed embodiments, but on the contrary, it is intended to cover the various modifications and equivalent arrangements included within the sphere and the scope of the appended claims.

We claim:

1. A dispenser for use with at least one stack or package of flexible sheet material comprising:

a housing having a horizontally-disposed lateral axis adapted for attachment to a wall;

low-friction support means operatively connected to said housing to decrease the friction on the bottom-most sheet of flexible material as the user pulls such sheet from said housing; and lateral pressure means operatively connected to said housing to provide force to the stack along the lateral axis of said housing thereby decreasing the vertical pressure and the corresponding friction on said support means and such sheet material, said force proportional to the weight on said support means.

2. The dispenser according to claim 1, wherein said low-friction support means comprises:

at least one major support roller capable of supporting the majority of the weight of the stack; and at least one rear support roller capable of supporting some of the weight of the stack.

3. The dispenser according to claim 2, wherein said at least one rear support roller comprises:

two rear support rollers.

4. The dispenser according to claim 1, wherein said lateral pressure means comprises:

a flat spring comprising an upper arm and a lower arm; wherein said flat spring is operatively connected to said housing.

5. The flat spring according to claim 4, wherein said upper arm is substantially longer than said lower arm.

6. The dispenser according to claim 5, wherein said flat spring is pivotally connected at its substantially central position to said housing at a location proximal to the juncture between said upper and lower arms.

7. The dispenser according to claim 1, wherein said lateral pressure means comprises:

a pivoting brake operatively connected to said housing.

8. The dispenser according to claim 7, wherein said lateral pressure means further comprises:

a connector operatively connected to said at least one major support roller, said connector contacting the pivoting brake in response to the weight of the stack when sufficient weight is present.

9. The dispenser according to claim 8, wherein said lateral pressure means further comprises:

at least one pivot arm connected to the connector and operatively connected to said housing.

10. The dispenser according to claim 9, wherein said lateral pressure means further comprises:

two pivot arms whereby each pivot arm is connected at one end to one of the ends of the connector and each pivot at the other end is connected to one of the ends of the major support roller.

11. The dispenser according to claim 1, wherein friction means is secured along a portion of the inner surface of said housing.

12. The dispenser according to claim 1, wherein a front cover is hingedly connected to said housing.

* * * * *